United States Patent [19]

Lucous

[11] 4,410,027

[45] Oct. 18, 1983

[54] RETAINER STRIP ASSEMBLY FOR FLEXIBLE SHEET MATERIAL

[76] Inventor: Robert W. Lucous, 1690 S. Shiloh Rd., Laura, Ohio 45337

[21] Appl. No.: 156,124

[22] Filed: Jun. 3, 1980

Related U.S. Application Data

[63] Continuation-in-part of Ser. No. 952,272, Oct. 18, 1978, abandoned.

[51] Int. Cl.[3] ..... A47G 5/00; A44B 21/00

[52] U.S. Cl. ..... 160/380; 160/392; 160/395

[58] Field of Search ..... 160/368 R, 369, 395, 160/402, 403, 392, 380, 394, 397; 24/201 C, 243 K; 248/74 A

[56] References Cited

U.S. PATENT DOCUMENTS

| | | | |
|---|---|---|---|
| 1,758,720 | 5/1930 | Sodergren | 160/392 |
| 2,378,163 | 6/1945 | Thomas | 160/392 |
| 2,526,912 | 10/1950 | Swanson | 160/392 X |
| 3,058,518 | 10/1962 | Housman | 160/380 |
| 3,068,939 | 12/1962 | Commisso | 160/392 |
| 3,143,165 | 8/1964 | Lewis et al. | 160/380 X |
| 3,187,801 | 6/1965 | Saling | 160/392 |
| 3,225,407 | 12/1965 | Daniels | 160/392 X |
| 3,302,260 | 2/1967 | Cuddeback | 160/392 X |
| 3,371,702 | 3/1968 | Keegan et al. | 160/392 |
| 3,421,276 | 1/1969 | La Barge | 160/395 X |
| 3,987,835 | 10/1976 | Bloomfield | 160/392 |
| 3,991,806 | 11/1976 | Abell | 160/395 X |
| 4,084,360 | 4/1978 | Reckson | 160/392 X |
| 4,107,826 | 8/1978 | Tysdal | 160/395 X |
| 4,133,367 | 1/1979 | Abell | 160/368 R |
| 4,164,105 | 8/1979 | Herbst et al. | 160/394 X |
| 4,170,810 | 10/1979 | Peleg | 160/395 X |

FOREIGN PATENT DOCUMENTS

| | | | |
|---|---|---|---|
| 894867 | 4/1962 | United Kingdom | 248/74 A |
| 1037236 | 7/1966 | United Kingdom | 160/392 |

*Primary Examiner*—Rodney M. Bonck
*Attorney, Agent, or Firm*—King and Liles

[57] ABSTRACT

A flexible sheet of material such as plastic film is attached to a supporting surface by a two-piece retainer strip assembly including a bottom strip member and a top strip member extruded from a semi-rigid plastics material and having the same width. The bottom strip member has a recess with undercut portions defined by opposing inwardly projecting protuberances, and the top strip member has an inner portion with outwardly projecting protuberances, one of which is formed with a cam surface. In one embodiment, the bottom strip member has projecting bottom corner portions which assure an air-tight seal between the bottom strip member and the supporting surface.

2 Claims, 8 Drawing Figures

RETAINER STRIP ASSEMBLY FOR FLEXIBLE SHEET MATERIAL

RELATED APPLICATION

This application is a continuation-in-part of application Ser. No. 952,272, filed Oct. 18, 1978, now abandoned.

BACKGROUND OF THE INVENTION

This invention relates to an improved retaining strip arrangement for gripping and supporting plastic sheet material. Prior retaining strips are shown in the following United States patents:

Saling, U.S. Pat. No. 3,187,801, issued June 8, 1965, is relevant to the invention as showing a two-piece strip for retaining plastic sheet material. A rectangular plastic insert is forced into a groove of the same shape formed in a metal retainer to wedge the plastic sheet therebetween and to cause tension to be placed on the sheet.

Cuddeback, U.S. Pat. No. 3,302,260, issued Feb. 7, 1967, is relevant as showing another form of flexible sheet retainer in which a generally C-shaped retainer member partially encircles an elongated bead to capture the material therebetween.

Keegan et al., U.S. Pat. No. 3,371,702, issued Mar. 5, 1968, shows a two-piece plastic retainer in which a bottom piece formed with a semi-circular opening may be nailed directly to the underlying structure, and a round elongated bead of plastic material is snapped into the groove formed in the base member to capture the plastic sheet therebetween.

Abel, U.S. Pat. No. 3,991,806, issued Nov. 16, 1976, is relevant as showing a base member formed of metal or other rigid material and in which a hollow oval shaped retainer or rod is pressed into a groove formed by the base member for retaining a sheet of plastic material.

Reckson, U.S. Pat. No. 4,084,360, issued Apr. 18, 1978, is relevant as showing a two-piece retainer for screening which is formed with a base member configured to accept either a hollow elongated rod or a rigid spline for retaining the screening material between the spline or the rod and the base member.

La Barge, U.S. Pat. No. 3,421,276, issued Jan. 14, 1969, is also relevant as showing a plastic sheet retainer in which a C-shaped opening is formed in a base member and a rod of plastic material is pressed into the opening to retain a sheet of plastic material.

Swanson, U.S. Pat. No. 2,526,912, issued Oct. 24, 1950, and discloses an extruded flexible retainer assembly for attaching adjacent edge portions of fabric panels to a support frame so that the panels are flush or form a corner.

Keegan et al., U.S. Pat. No. 3,371,702, issued Mar. 5, 1968, illustrates an extruded triangular retainer strip which mounts within a corner of a window frame and has a groove for receiving an extruded resilient cylindrical bead.

Bloomfield, U.S. Pat. No. 3,987,835, discloses various embodiments of a retainer assembly for a flexible sheet material, each of which incorporates an extruded metal channel for receiving an extruded flexible or foldable retainer strip.

SUMMARY OF THE INVENTION

The present invention is distinguished by the provision of an elongated two-piece retainer for flexible sheet material in which a top strip member is particularly configured to engage by pivotal movement into a bottom or base retaining member, to cause a predetermined stretching or tensioning in the sheet material and which, when assembled, is essentially self-locking and holding in that tension applied to the sheet material causes the retainer or insert to be urged against cooperating latching portions formed on the base member and on the insert.

More particularly, the invention is directed to a two-piece retainer in which both pieces are preferably formed of extruded semi-rigid plastics material. The bottom or base member is characterized by front and back walls which are spaced apart along a transverse bottom and which define therebetween a generally channel-shaped recess. The front wall is formed with an inwardly extending protuberance which partially overlies the recess and which mates with a generally conforming recess formed in the top member. The back wall of the bottom or base member is formed with a latching projection while the top member is formed with a cooperating latching portion which is adapted to be captured in underlying relation to the latching projection of the bottom member. The top strip member is inserted into the base member with a rocking and camming movement, with the sheet material therebetween, thus creating tension on the sheet material as it is gripped over the cooperating protuberances and is driven into the recess. This same rocking movement, when the parts are pressed together, causes the cooperating latching portions to be engaged, and tension applied outwardly on the captured sheet material has the effect of urging the latching portion of the retainer or the top member into even firmer engagement with the cooperating latch formed on the back wall of the bottom member.

A clearance space may be provided between the members to accommodate the heads of screws or nails which may be driven through the base member for retaining the same to an underlying structure. When the parts are assembled, an inwardly opening tapered recess is formed between the upper surface of the front wall and the head of the top member to permit the plastic sheet material to exit therefrom without incurring strains or without presenting a cutting edge to the sheet material.

The two-piece retainer strip of the present invention is particularly useful in retaining a wide variety of flexible sheet materials in a wide variety of applications. One application is that of several of the references identified above, for use in retaining clear plastic film material about the margins of an existing window, to create a storm window. The same retainer may be used in the summer months to support flexible vinyl screening. The retainer strip may be employed on boats and campers to hold canvas in place and may also be employed on trash bins and waste baskets and the like to retain plastic linings along the margins of the container opening, for example.

It is accordingly an object of the invention to provide a two-piece retainer strip assembly in which top and bottom strip members interlock to provide positive gripping of flexible sheet material retained therebetween and to provide a self-locking feature. When the retainer top strip member is in place, it provides forwardly and rearwardly extending projections which respectively overlie the front and rear walls of the base member to cover the base member from view and to provide protection for the sheet material gripped therebetween.

These and other objects and advantages of the invention will be apparent from the following description, the accompanying drawings and the appended claims.

DESCRIPTION OF THE PREFERRED EMBODIMENTS

Figure 1:
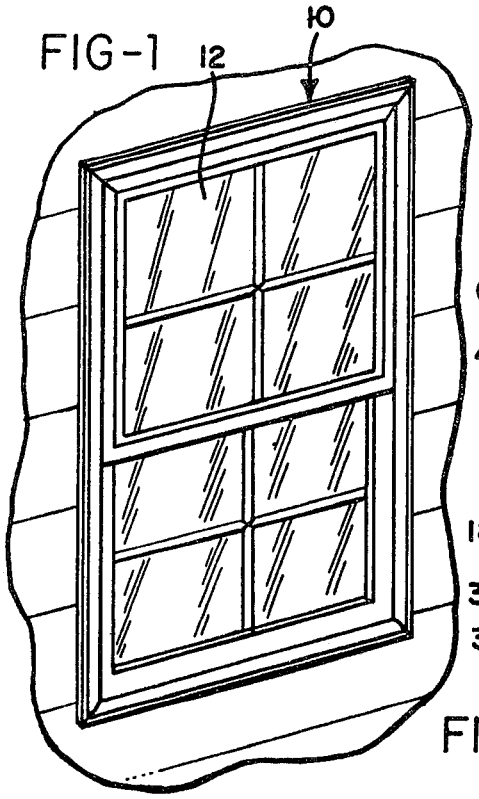
FIG. 1 is a perspective view showing a window to which the retainer strip of the present invention has been applied.
Figure 2:
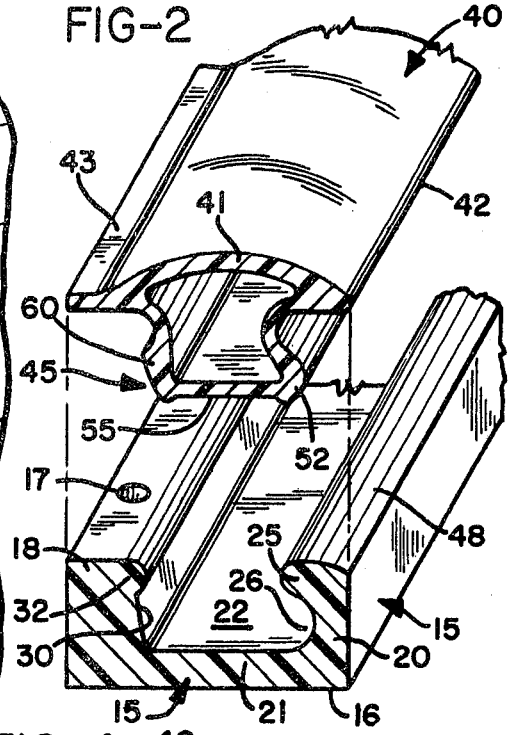
FIG. 2 is a perspective section view of top and bottom retainer strip members constructed in accordance with one embodiment of the present invention.
Figure 3:
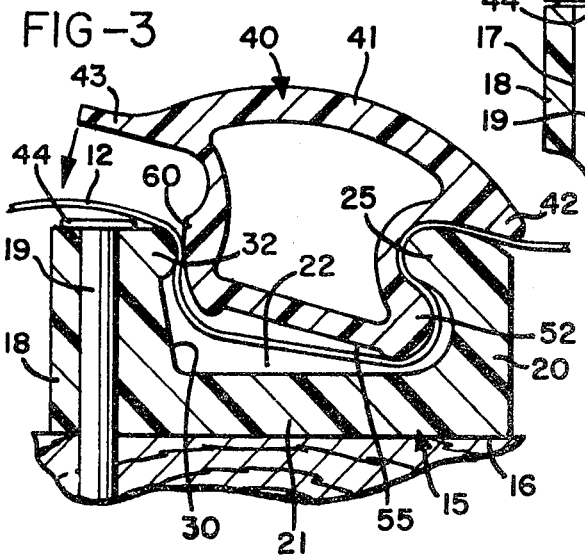
FIG. 3 is an enlarged cross-sectional view showing the manner in which the top retainer member is pivoted or rocked into interlocking relation with the bottom retaining member.
Figure 4:
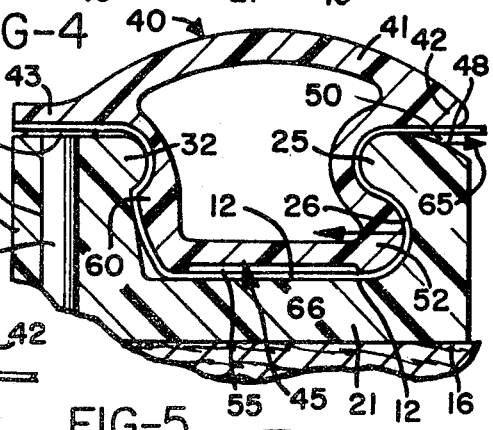
FIG. 4 is a cross-sectional view similar to FIG. 3 showing the top and bottom retaining members in assembled relation with a sheet of plastic material captured therebetween.

Referring first to FIG. 1, a window is shown in which a two-piece retainer strip assembly 10 of this invention is shown as being applied to the marginal window framing and mitered at corners to provide an auxiliary framing at the window for supporting a sheet 12 of clear plastics material. The two-piece retainer in a first embodiment of the invention, as shown in FIGS. 2–4, includes a bottom member 15 which may be extruded of rigid or semi-rigid plastic material such as acrylonitrile-butadiene-styrene (ABS) or polystyrene resins.

The bottom strip member 15 has an outer or bottom surface 16 which is adapted for fastening to the window framing or the like. Nails may be driven directly through the bottom, or, where desired, apertures or holes 17 may be preformed in the back wall 18 for the purpose of easily accepting retaining nails 19 as shown in FIGS. 3 and 4.

The bottom member is generally channel-shaped as it is formed with a front wall 20 and the back wall 18, which are spaced apart on a base or bottom wall 21 to define therebetween a generally channel-shaped recess.

The front wall 20 has means thereon defining a smoothly curved protuberance 25 which extends inwardly in partially overlying relation to the recess 22 thereby forming an undercut recess 26 between the protuberance 25 and the base 21 of the bottom member 15.

The back wall 18 is formed with a somewhat outwardly sloping inner surface 30 terminating, along its upper marginal edge in an inwardly projecting latching portion 32. As shown in FIGS. 2 and 3, the back wall 18, in this embodiment, is somewhat thicker in transverse dimension than the front wall 20 to receive the nails or fasteners 19.

Figure 5:
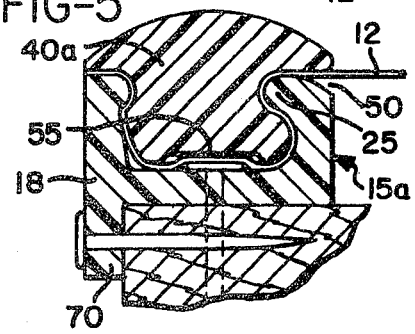
FIG. 5 is a sectional view through a slightly modified form of the invention.

The two-piece retainer includes an extruded top member or insert 40 which is also preferably formed of plastic material, such as polystyrene, which may be hollow as shown in FIGS. 2–4 or solid as shown in FIG. 5. The top member 40 has a transverse top 41 which is proportioned when assembled, to overlie the exposed upper surfaces of the back and front walls 18 and 20. Thus, the top 41 has a forward extension portion 42 which overlies the front wall 20 and a rearward extension portion 43 which overlies the back wall 18 and which overlies the heads 44 of the nails or fasteners so that they are hidden from view when the parts are assembled.

The top member 40 also has a depending insert portion illustrated generally at 45 which is configured in generally conforming relation to the recess 22 and is insertable into the recess to capture the sheet material 12 therebetween with the sheet material overlying the tops of the front and rear walls and extending outwardly of the front wall 20, as shown in FIG. 4. Also, the front wall 20 is formed with a downwardly tapering upper surface 48 which defines an outwardly tapering slot 50 with the forward extension edge 42 of the upper member 40. The slot 50 provides relief from any strain on the sheet material 12 as the exit region of the retainer strip of this invention.

As noted, the insert portion 45 of the top member 40 is configured in generally conforming relation to the recess 22 so as to capture the sheet material therebetween with the sheet material overlying the front and rear walls. Thus, the insert portion 45 is formed with an outwardly protruding or extending bottom portion 52 which is proportioned to be received with the undercut or recess 26 formed beneath or underlying the inwardly extending protuberance 25. The bottom of the insert is slightly relieved as shown at 55 to provide a clearance space with the base 21 of the lower member 15 so as to provide a slight clearance space to receive the heads of nails or fasteners driven through the bottom member, as shown in FIG. 5. The top member 40 further includes a cooperating outwardly extending latch 60 which is adapted to be captured in underlying relation to the inwardly extending latching portion 32 of the back wall 18, as shown in FIG. 4.

The upper member 40 is shown in the embodiments of FIGS. 2–4 as being hollow, and this construction is preferred where relatively large components are employed, in order to conserve material. However, in the embodiment of FIG. 5, a solid member **40*a*** is shown.

In the operation of the invention, the plastic material 12 is stretched across the opening or recess 22 and across the upper surfaces of the front and back walls of the lower member 15, and the top member is inserted first by engaging the forward portion or protuberance 52 into the recess 26 as shown in FIG. 3, and then pressing down to bring the latch 60 into engagement with the latching protuberance portion 32, as shown in FIG. 4. This movement applies a stretching force to the sheet material and prevents its dislodgment since the sheet material is first captured along the curvature of the forward wall during the insertion process. It will also be seen that any tension applied to the sheet material will be in the direction of the arrow 65 as shown in FIG. 4. The sheet material tends to straighten itself out along the generally S-shaped path or curvature defined between the top member 40 and the front wall 20, thus causing a force to be applied to the insert portion 45 in the direction of the arrow 66, which thereby causes the insert to be pressed even tighter against the cooperating latch portions 32 and 60.

In the embodiment of the invention shown in FIG. 5, a slightly modified form of the bottom member is shown at 15*a* as including a downwardly depending flange 70 formed as a part of the back wall 18. The flange 70 may be employed for mounting, as shown in FIG. 5, by driving nails therethrough. However, if desired, the flange 70 may be omitted to permit flush mounting of the bottom member by suitable nails driven through the bottom member with the heads received within the clearance 55 formed thereunder. In this embodiment, the top member 40*a* has essentially the same outer configuration as that of the member 40, except that it is formed solid. Both parts may conveniently be formed of a substantially rigid polystyrene material which can easily be cut and trimmed to shape with a sharp pocket knife.

Figure 6:
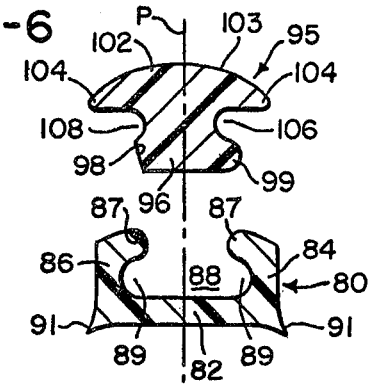
FIG. 6 is a section of separated top and bottom strip members constructed in accordance with a modification of the invention.
Figure 7:
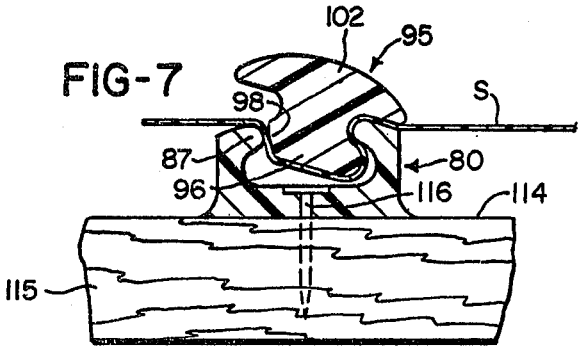
FIG. 7 is a section showing the strip members of FIG. 6 in position for clamping a flexible sheet of material.
Figure 8:
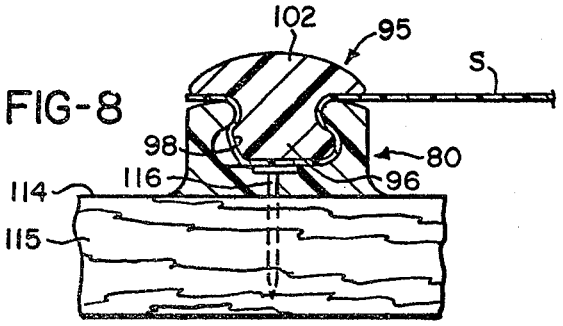
FIG. 8 is a section similar to FIG. 7 and showing the strip members assembled with the sheet material locked therebetween.

Another embodiment of the invention is illustrated in FIGS. 6–8 and is similar to the embodiment shown in FIG. 5. In this embodiment, a base or bottom strip member 80 is extruded of a semi-rigid plastics material and includes a generally flat base wall 82 which integrally connects a front wall 84 and a back wall 86 to form a channel-like cross-sectional configuration. The bottom strip member 80 is symmetrical about a center plane P, and each of the walls 84 and 86 includes an inwardly projecting protuberance 87 defining a recess 88 having undercut portions 89 under the protuberances 87. The bottom corner portions 91 project outwardly and downwardly from the base wall 82 to form V-shaped corners having slight flexibility.

The retainer strip assembly shown in FIG. 6 also includes a top strip member 95 which is preferrably extruded from the same semi-rigid plastics material as the bottom strip member 80 and has a cross-sectional configuration substantially the same as the strip member 40*a* described above in reference to FIG. 5. Thus the top strip member 95 includes an inner portion 96 with a cam surface 98 along one side and a rounded protuberance 99 along the other side, resulting in the top strip member 95 being non-symmetrical about the center plane P. The outer portion 102 of the top strip member 95 has a rounded outer surface 103 which extends to form opposite tapering edge portions or flanges 104 defining an overall width which is substantially the same as the overall width of the bottom strip member 80. As apparent from FIG. 6, the protuberance 99 and the overlying edge flange 104 of the top strip member 95 define a groove 106 which has a depth greater than the depth of the groove 108 defined between the cam surface 98 and the overlying edge flange 104 of the top strip member.

As shown in FIG. 7, the bottom strip member 80 is attached to the flat surface 114 of a wooden window frame member 115 by a series of longitudinally spaced fasteners or nails 116. When the nails are driven through the bottom wall 82 of the bottom strip member 80, the corner portions 91 of the bottom strip member assure a continuous air-tight seal between the bottom strip member and the surface 114 by accommodating irregularities in the flatness of the surface 114 between the nails 116. When the top strip member 95 is inserted into the recess 88 of the bottom strip member 80 with a sheet S of flexible material therebetween, the top strip member 95 is rolled into the recess 88. The cam surface 98 is effective to separate or press the protrusions 87 apart slightly until the groove 108 receives the mating protrusion 87 when the top strip member 95 snaps into the bottom strip member 80, as shown in FIG. 8.

After the assembly of the strip members 80 and 95, the film or sheet material S is positively captured and retained between the strip members. The outer edge portion of the sheet S may then be cut or trimmed flush with the back or outer surface of the bottom strip member 80, as shown in FIG. 8. When it is desired to separate the strip members to remove the sheet S, the back edge flange 104 is lifted or snapped back to the position shown in FIG. 7 causing the back protrusion 87 to be cammed out of the groove 108 and a slight spreading of the protrusions 87.

It will therefore be seen that this invention provides a two-piece retainer strip assembly which is adapted to grip and support a wide variety of flexible sheet materials and which is adapted to be mounted on a wide variety of underlying surfaces. For example, the invention is not limited to use with clear plastic sheet materials, and may be employed for supporting flexible vinyl screening or the like, or may be used to grip and support upholstery material or other cloths, or may be employed to grip and retain the marginal edge of a canvas. The retaining strip may be reused, and the top or insert strip member is easy to assemble by employing the rocking motion as shown in FIGS. 3 and 7. The rigidity of the strip assembly provides for the snap action and also prevents bowing or sagging of the strip members between the nails. The assembly also provides a neat and attractive appearance. The embodiment shown in FIGS. 6–8 further simplifies the mounting of the bottom strip member 80 since the member is symmetrical about the center plane P and thus does not require orientation. In addition, the flexible corner portions 91 provide for a continuous air-tight seal between the bottom strip member 80 and its supporting surface.

While the forms of strip assemblies herein described constitute preferred embodiments of this invention, it is to be understood that the invention is not limited to these precise assemblies, and that changes may be made therein without departing from the scope of the invention.

What is claimed is:

1. An improved elongated two-piece retainer strip assembly adapted to be mounted on a surface surrounding a window for gripping and retaining a panel of flexible sheet material, said strip assembly comprising an extruded single piece bottom strip member of semi-rigid plastics material, said bottom strip member being symmetrical about a longitudinally extending center plane, and including a generally flat base wall being piercable by a plurality of longitudinally spaced nails adapted to project perpendicular from said base wall to secure said bottom strip member to the surface, a front wall and a back wall projecting from said base wall and cooperating therewith to define a generally channel-shaped recess, said front and back walls each having a protuberance extending inwardly in partially overlying relation to said recess to form opposing undercut portions of said recess between said protuberances and said base wall, an extruded single piece top strip member of semi-rigid plastics material, said top strip member being non-symmetrical about a longitudinally extending center plane and having an inner portion with protuberances projecting outwardly into said undercut portions of said recess for capturing the sheet material within said recess with the sheet material overlying said front and back walls, said top strip member including an outer portion having opposite outwardly projecting edge flanges overlying said front and back walls of said bottom strip member and providing said top strip member with a width generally the same as the width of said bottom strip member, one of said edge flanges on said top strip member cooperating with the underlying said protuberance on said top strip member to define a groove having a depth greater than the depth of the groove defined by the opposite said edge flange and the underlying said protuberance to provide for inserting said semi-rigid top strip member and the sheet material into said bottom strip member while providing for conveniently removing said top strip member from said bottom strip member, and said bottom strip member including longitudinally extending flexible bottom corner portions projecting laterally outwardly from said front and back walls and downwardly from said base wall to provide an air-tight seal between said bottom strip member and the supporting surface between the nails.

2. A strip assembly as defined in claim 1 wherein one of said protuberances on said inner portion of said top strip member has an outer cam surface sloping from the corresponding said groove downwardly and inwardly towards the center plane to facilitate inserting said top strip member into said bottom strip member with the sheet material therebetween.

* * * * *